United States Patent [19]

Gregor et al.

[11] 4,340,987

[45] Jul. 27, 1982

[54] ELEMENT FOR CLEANING COKING-OVEN DOORS AND DOORJAMB

[75] Inventors: Karl Gregor, Bochum; Karl Feldhaus, Gelsenkirchen, both of Fed. Rep. of Germany

[73] Assignee: Gewerkschaft Schalker Eisenhütte, Gelsenkirchen, Fed. Rep. of Germany

[21] Appl. No.: 172,267

[22] Filed: Jul. 25, 1980

[30] Foreign Application Priority Data

Jul. 26, 1979 [DE] Fed. Rep. of Germany ..... 2930350

[51] Int. Cl.[3] ..... C10B 43/04

[52] U.S. Cl. ..... 15/93 A; 202/241

[58] Field of Search ..... 15/93 A; 202/241

[56] References Cited

U.S. PATENT DOCUMENTS 3,056,6 99 10/1962 Randell et al. ..... 15/93 A X

*Primary Examiner*—Edward L. Roberts

*Attorney, Agent, or Firm*—Karl F. Ross

[57] ABSTRACT

An apparatus having an element for cleaning deposits from the edge of a doorjamb or door of a coking oven is provided with a heater for maintaining this element at a temperature above the softening point of the deposits, normally around 150° C. The element may be a scraper or brush and the heater may be an electrical resistance-type heater, a device for directing a heated gas stream at the element, or a system wherein a heated fluid is passed through the element.

5 Claims, 4 Drawing Figures

ELEMENT FOR CLEANING COKING-OVEN DOORS AND DOORJAMB

FIELD OF THE INVENTION

The present invention relates to an apparatus having an element for cleaning deposits from the edge of a doorjamb or door of a coking oven.

BACKGROUND OF THE INVENTION

In a coking operation it is necessary to clean the edges of the coke-oven doors and doorjambs with each operation cycle. Thus each time a coke-oven door is removed and the charge is pushed out of the respective oven the doorjamb edges and the edges of the door must be cleaned so that the door can be replaced to make a good seal. This procedure is described in The Making, Shaping and Treating of Steel, edited by H. E. McGannon (Herbick & Held: 1971) at pages 129 sf.

The main problem with such devices is that the tarry carbon deposits that build up on the edges of the doors and doorjambs quickly foul the cleaning element. When a scraper is used such as described in German utility model 1,994,711 it is rapidly so heavily crusted with these carbonaceous deposits that it cannot clean properly. Thus the cleaning operation must be slowed down considerably to allow the fouled tool to do the job, or a potentially unsatisfactory cleaning job, which could lead to dangerous leaks, must be accepted. Otherwise the scraper must itself be periodically cleaned. None of these solutions is satisfactory.

The use of a rotary brush as described in German Pat. No. 2,332,027 does give satisfactory cleaning for a while at least, as it is somewhat more difficult to encrust with the tarry deposits, yet nonetheless with time even a large brush can become so heavily coated as to be ineffective. Cleaning the deposits off the brush is an even more onerous task than cleaning them off a scraper.

Finally it has been suggested in German printed patent application No. 2,143,595 to clean the door and the doorjamb edges wholly hydraulically with high-pressure water sprays. Such a system is extremely messy. Furthermore the deposits are normally water insoluble so that the water must work with a wholly hydraulic effect. The result is an often inadequate cleaning job.

OBJECTS OF THE INVENTION

It is therefore an object of the present invention to provide an improved apparatus for cleaning deposits from the edge of a doorjamb or door of a coking oven.

Another object is to provide such an apparatus which effectively cleans the doorjamb or door edges, yet which itself is not prone at fouling.

SUMMARY OF THE INVENTION

These objects are attained according to the instant invention by the expedient of heating the element to a temperature above the softening point of the deposits to be cleaned off the edges. This temperature lies normally between 100° C. and 200° C. Below 100° C. the temperature is insufficient to soften the tarry deposits, and above 200° C. the deposits are burned and emit noxious vapors.

With the system according to the instant invention, therefore, the deposits which are scraped off the door and doorjamb edges and which partially adhere to the cleaning element remain, at worst, sufficiently soft so they do not interfere with the operation of this element.

Normally they are so very softened by the hot element that they simply do not adhere to it and fall off it. Nonetheless even if the element does become relatively covered with the tarry mass, this mass remains so soft that it does not actually interfere with the operation of the cleaning element. In fact the mass even increases the heat exchange between the element and the crusted deposits on the door and doorjamb edges so as to enhance the cleaning effect. In any case the outer 2 cm of a scraper blade constituting the element normally remain perfectly clear so that the cleaning effect will be excellent. The system therefore eliminates the need of periodically cleaning the cleaning element.

The cleaning element can be heated in a simple embodiment of the invention simply by providing it internally with a resistance-type electrical heater. To this end a power supply which is normally remote from the cleaning element is connected to this heater to energize it to keep it at the desired temperature, normally about 150° C. It is further within the scope of this invention to provide a temperature sensor or detector, for example a thermocouple, directly in the element which gives an output, for example a varying resistance, which is directly proportional to the temperature of the element. This output is compared with a set-point signal, that is normally a fixed resistance in the case of a thermocouple, and an error signal is generated which is fed to the power supply to increase the electrical energization of the resistance heater when the detected temperature is too low or to decrease it when it is too high.

When a brush is used as the cleaning element such an electrical heater is possible, but experience has shown that heating the metal bristles of such a brush is most advantageously done by directing a stream of heated air at them. This stream of air not only heats the bristles but can be in part used to blow off the softened tar deposits thereon. Such an arrangement can also be provided with a feedback system having, as mentioned above, a temperature sensor right in the cleaning element.

According to further features of this invention the element may be partially hollow and a heated fluid may be passed through it to maintain it at the desired temperature. This fluid is for best heat exchange normally a liquid which has a boiling point above the operation temperature of the cleaning element. Oil can be used. It is also possible, of course, to use water which is maintained under pressure to prevent it from vaporizing.

The cleaning element according to this invention may be heated continuously, at least during its duty cycle. It is also within the scope of this invention to merely heat the cleaning element periodically so as periodically to soften the deposits on it. No matter whether the heating is continuous or discontinuous, however, any of the above-described heating arrangements can be used.

The exact temperature at which the cleaning element is to be maintained during the cleaning operation can, of course, be varied somewhat in accordance with the particular operating circumstances. It is for this purpose that having a temperature detector which can give the operator of the machine a readout of the actual temperature of the cleaning element is particularly useful.

SPECIFIC DESCRIPTION

Figure 1:
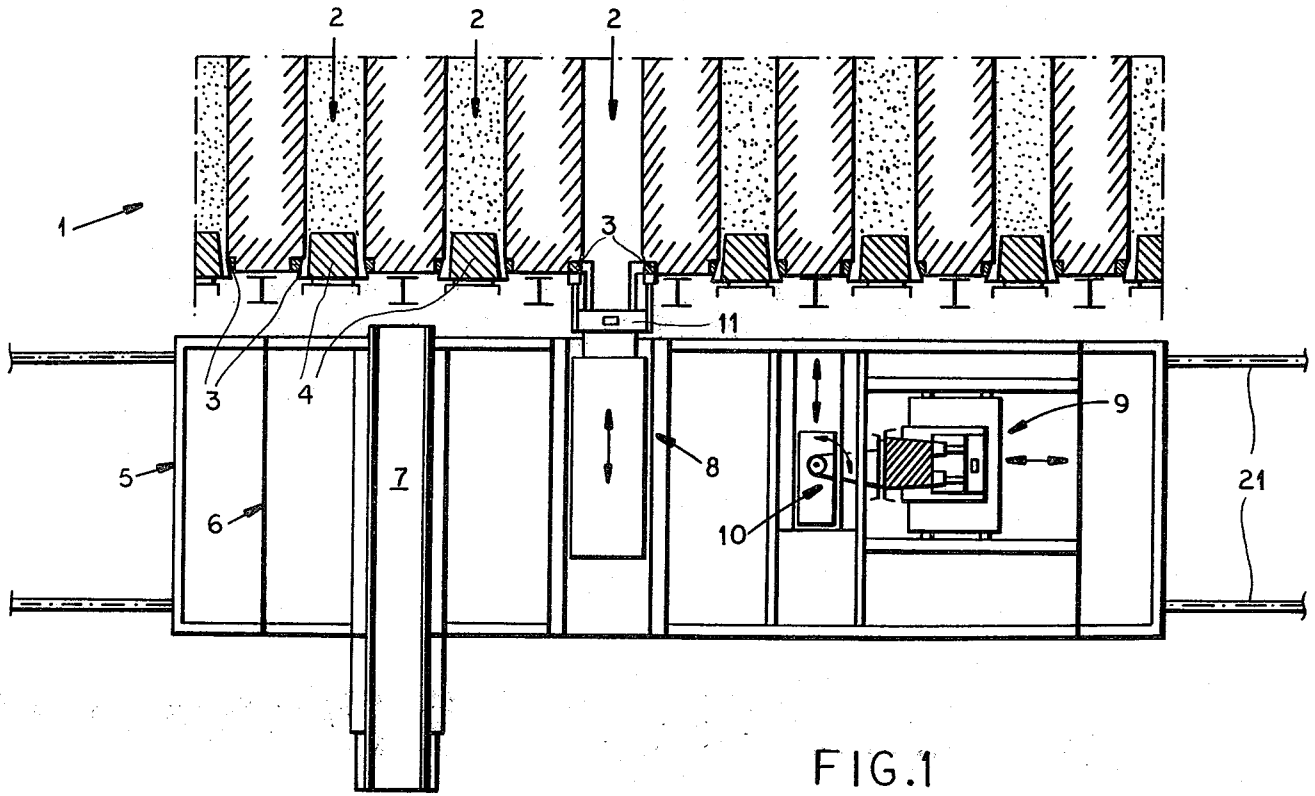
FIG. 1 is a top view of a coking oven equipped with the apparatus according to this invention.

As shown in FIG. 1 a coking oven 1 has a battery of coking chambers 2 each having a doorjamb 3 and a door 4 of the type described at pages 120–123 of The Making, Shaping and Treating of Steel (Op. Cit.). A car 5 can move on tracks 21 adjacent the coking battery 1 and has a frame 6 carrying a pusher 7, a doorjamb cleaner 8, a door cleaner 9, and a door extractor 10. The pusher 7 and extractor 10 are of standard construction.

Figure 2:
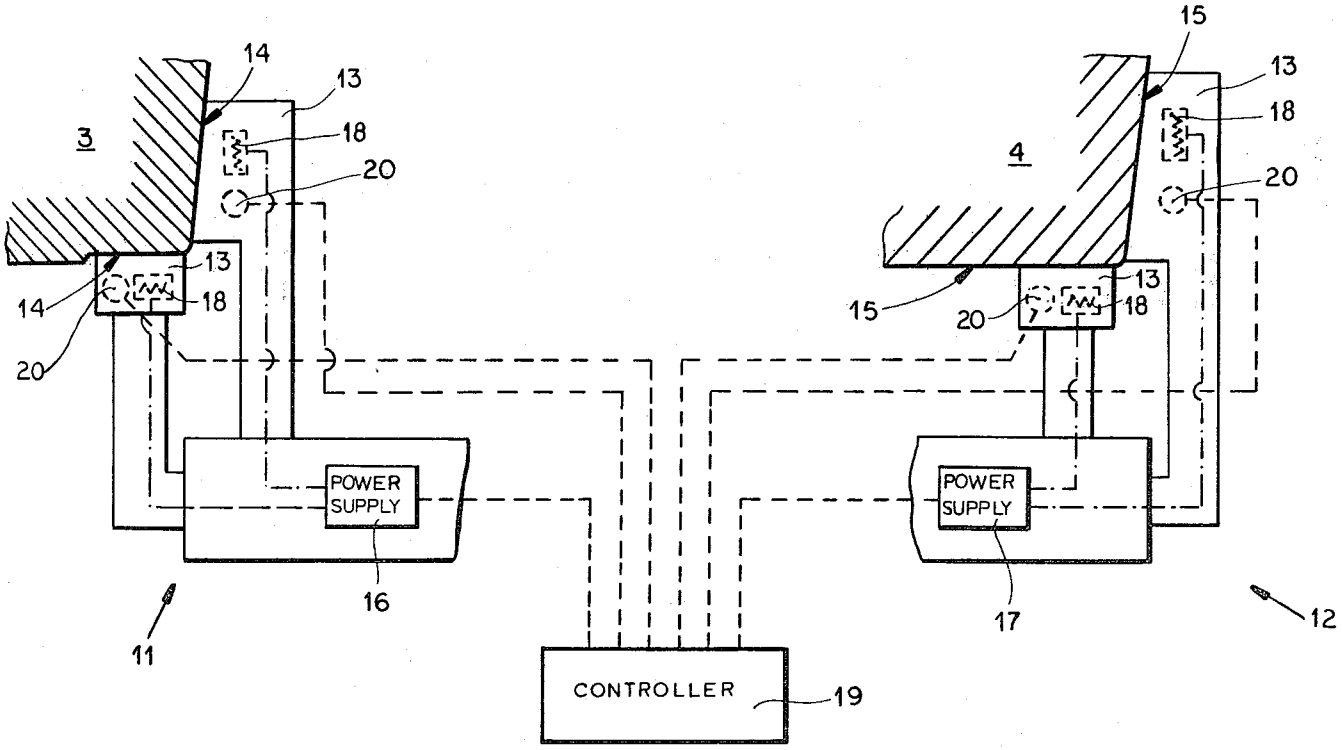
FIG. 2 is a large-scale partly schematic view of the apparatus according to the present invention.

As better seen in FIG. 2 the cleaners 8 and 9 have respective cleaning heads 11 and 12 having identical cleaning-element scrapers 13 having faces shaped to engage the respective doorjamb edges and door edges 14 and 15. Normally the face edge and the side edge of each door and doorjamb must be scraped clean of deposits to ensure a good seal when the door 4 is replaced against the jamb 3.

According to the instant invention each of the scrapers 13 is provided with a resistance-type heater 18 and a temperature sensor 20. The heaters 18 are cartridges and are connected to a power supply 17 operated by a controller 19 also connected to the sensors 20.

The controller 19 receives signals from the sensors 20 which correspond to the actual temperatures of the respective scrapers 13. If a semiconductor-type thermocouple is used as the sensor 20 the signal will be a resistance that varies directly with the temperature. The controller compares the signal received from each sensor 20 with a set point established by a built-in potentiometer that is set by the operator of the machine at the desired temperature. If the actual temperature of a scraper 13 is less than the desired temperature thereof, indicated by a resistance of the respective thermocouple which is greater than that of the respective potentiometer generating the set point, the respective power supply 16 is energized to increase the electrical flow through the respective heater 18 to raise the temperature, and vice-versa if the temperature is too high.

Thus, with this system the temperature of the scrapers 15 is maintained between 100° C. and 200° C., normally at 150° C. Deposits from the edges 14 and 15 which build up on the scrapers 13 therefore will either be softened so much that they fall off the scraper 13, or will be so soft that they will not interfere with its operation.

Figure 3:
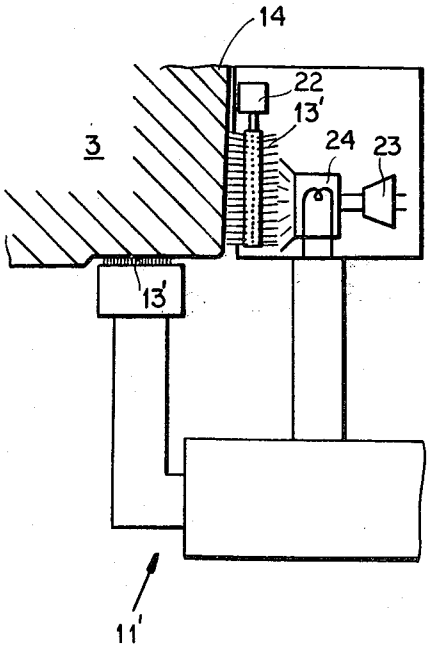

FIG. 3 shows an arrangement wherein the cleaner head 11′ has brushes 13′ instead of scrapers 13. Each of these brushes is driven by a respective motor 22 and is heated by a stream of air coming from a blower 23 and passing through a resistor-type heater 24. These streams of air maintain the temperatures of the respective brushes at the desired level. With such an arrangement, therefore, the material adhering to the metal bristles of the brushes 13′ will be softened so much that it will be thrown from these brushes as they rotate.

Figure 4:
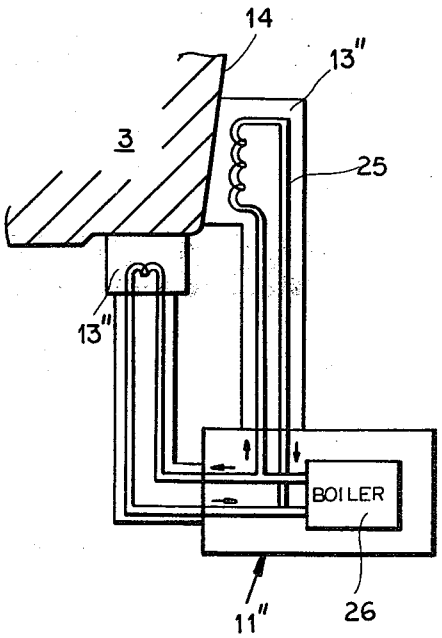
FIGS. 3 and 4 are views showing alternate apparatuses according to this invention.

FIG. 4 shows another arrangement wherein scrapers 13″ are provided which are internally formed with passages 25 through which a liquid is flowed from a boiler 26 inside the respective head 11″. This liquid is normally an oil having a boiling point above the operating temperature for the scrapers 13″, so that good heat exchange is obtained without vaporization of the liquid.

Obviously both of the systems shown in FIGS. 3 and 4 can be provided with feedback arrangements having sensors such as shown at 20 in FIG. 2.

I claim:

1. In an apparatus having an element for cleaning deposits from the edge of a doorjamb or door of a coking oven, the improvement comprising:
   - means for heating said element to a temperature above the softening point of said deposits; and
   - control means including
   - a temperature sensor in said element for detecting the actual temperature thereof and
   - means for applying heat to said element to heat same sufficiently to raise its temperature from its actual temperature to a temperature between 100° C. and 200° C. for maintaining said temperature between 100° C. and 200° C.

2. The improvement defined in claim 1 wherein said means includes an electrical resistance-type heater in said element.

3. The improvement defined in claim 2 wherein said means includes power-supply means remote from said element and connected to said heater for energizing same electrically to heat same to between 100° C. and 200° C.

4. The improvement defined in claim 1 wherein said means only heats said element periodically.

5. The improvement defined in claim 1 wherein said element is a scraper.

* * * * *